US007438086B2

(12) United States Patent
Bento et al.

(10) Patent No.: US 7,438,086 B2
(45) Date of Patent: Oct. 21, 2008

(54) DYNAMIC FLUID POWER MONITORING SYSTEM FOR SEPARATE ACTUATORS

(75) Inventors: Jose Carlos Bento, São Paulo (BR); Neil E. Russell, Bloomfield Hills, MI (US); Joseph E. Foster, Sterling Heights, MI (US); Detlef Zimmerling, Langen (DE)

(73) Assignee: Ross Controls, Troy, MI (US)

( * ) Notice: Subject to any disclaimer, the term of this patent is extended or adjusted under 35 U.S.C. 154(b) by 469 days.

(21) Appl. No.: 11/345,985

(22) Filed: Feb. 2, 2006

(65) Prior Publication Data

US 2007/0175527 A1 Aug. 2, 2007

(51) Int. Cl.
*F15B 20/00* (2006.01)

(52) U.S. Cl. ..... 137/596.16; 137/596.18; 91/448

(58) Field of Classification Search ..... 137/14, 137/596.16, 596.18; 91/424, 448
See application file for complete search history.

(56) References Cited

U.S. PATENT DOCUMENTS 2,906,246 A * 9/1959 Di Tirro et al. ..... 91/433
3,043,335 A * 7/1962 Hunt ..... 91/448
3,108,612 A * 10/1963 Hofmann et al. ..... 137/596.16
3,265,089 A * 8/1966 Nill ..... 137/596.16
3,848,848 A * 11/1974 Di Tirro ..... 91/424
3,858,606 A * 1/1975 Cameron ..... 137/596.16
4,181,148 A * 1/1980 Russell et al. ..... 137/596.16
4,237,930 A * 12/1980 Herion et al. ..... 137/596.16
4,257,455 A * 3/1981 Cameron ..... 137/596.16
4,748,896 A * 6/1988 Ott et al. ..... 91/448
5,927,324 A 7/1999 Russell et al.
6,478,049 B2 11/2002 Bento et al.
6,840,258 B1 1/2005 Russell et al.
6,840,259 B1 1/2005 Russell et al.

* cited by examiner

*Primary Examiner*—John Rivell
*Assistant Examiner*—Craig Price

(57) ABSTRACT

A control valve apparatus couples pressurized fluid to first and second actuators using first and second double valves. The first double valve includes first and second crossover passages and first and second pilots. The second double valve includes third and fourth crossover passages and third and fourth pilots. A first interconnection couples the first crossover passage with the third pilot fluid inlet. A second interconnection couples the second crossover passage with the fourth pilot fluid inlet. A third interconnection couples the third crossover passage with the first pilot fluid inlet. A fourth interconnection couples the fourth crossover passage with the second pilot fluid inlet. Thus, operation of each pilot depends upon receiving pressurized fluid from the other double valve which is only present when the other double valve is not in a fault condition.

16 Claims, 6 Drawing Sheets

DYNAMIC FLUID POWER MONITORING SYSTEM FOR SEPARATE ACTUATORS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to control valve systems for operating multiple actuators, and, more specifically, to interconnecting control valves for separate actuators such that a fault in one control valve quickly results in deactuation of the other control valve.

The operation of fluid power controlled machinery, such as a mechanical power press, can damage a press or cause an unsafe condition if not properly controlled. In order to comply with engineering standards, governmental regulations, and good practice, a double valve is typically used as a control element for such machinery so that upon an operational malfunction, such as a valve failure, a press repeat, or overrun cycle due to a single malfunction of a valve, damage to the press or unsafe conditions can be avoided. The use of a double valve also provides the advantage of automatic lockout of valve operation during an operational malfunction to prevent further machine cycling until the malfunction can be corrected and the valve reset. Examples of double valves satisfying the forgoing requirements are shown in U.S. Pat. Nos. 6,840,258 and 6,840,259, both assigned to Ross Operating Valve Company and both incorporated herein by reference.

Large presses typically have separate clutches and brakes for controlling their operation. A double valve controlling the brake actuator is actuated in order to supply fluid power pressure to disengage the brake. A second double valve controlling the clutch actuator is actuated to engage the clutch so that motive power is applied to the press. The timing of the actuation and deactuation of the clutch and brake must be accurately controlled in order to avoid damage to the press. For example, a failure in the brake double valve causing the brake actuator to release so that the brake is applied at the same time that the clutch actuator is still engaged could result in attempting to cycle the press while the brake is engaged. Attempting to cycle the press while the brake is engaged can cause an unsafe condition or damage the actuators or the press. Therefore, when one of the double valves becomes faulted, the other valve must be quickly deactuated so that such a simultaneous actuation is avoided.

Conventional techniques for addressing the potential problem of continued operation of one double valve when the other valve is faulted have been subject to various disadvantages which have resulted in them being unacceptable under the relevant standards. Examples of prior art methods include the use of flow control valves connected between each double valve and its respective actuator, quick dump valves connected to the clutch actuator for timing, or pressure switches used to indicate a valve fault and to cause a second valve to deactuate.

Another prior art approach has been to slow the actuation time of the clutch control valve by restricting the inlet supply to the pilots. Simultaneously, deactuation time of the brake valve has been slowed by restricting the exhaust ports of the pilots. This arrangement prevents overlap of the clutch and brake during normal operation, but does not monitor the system for valve faults. Therefore, additional components need to be used to monitor the system and to deactuate both valves whenever either valve enters a fault state. A similar method to prevent overlap of the clutch and brake operation has been to restrict airflow to the main inlet of the clutch control valve and to restrict the main exhaust of the brake control valve. This alternative method similarly requires additional components for monitoring and deactuating both valves whenever either valve becomes faulted.

SUMMARY OF THE INVENTION

The present invention dynamically controls the double valves in a manner that advantageously ensures that whenever one double valve faults then the other double valve quickly deactuates. The invention avoids additional valve components or deliberately degrading the timing performance of the double valves. The double valves are interconnected so that operation of each pilot valve depends upon receiving pressurized fluid from the other valve which is only present when the other double valve is not in a fault condition.

In one aspect of the invention, a control valve apparatus couples pressurized fluid to first and second actuators using first and second double valves. The first double valve comprises a first inlet for receiving the pressurized fluid, a first outlet for coupling with the first actuator, and a first exhaust. A first valve element of the first double valve has a first inlet poppet and a first flow restrictor. A second valve element of the first double valve has a second inlet poppet and a second flow restrictor. The first double valve further includes a first crossover passage fluidically coupling the first flow restrictor to the second inlet poppet and a second crossover passage coupling the second flow restrictor to the first inlet poppet. The second double valve comprises a second inlet for receiving the pressurized fluid, a second outlet for coupling with the second actuator, and a second exhaust. A third valve element of the second double valve has a third inlet poppet and a third flow restrictor. A fourth valve element of the second double valve has a fourth inlet poppet and a fourth flow restrictor. The second double valve further includes a third crossover passage fluidically coupling the third flow restrictor to the fourth inlet poppet and a fourth crossover passage coupling the fourth flow restrictor to the third inlet poppet. A first pilot is fluidically coupled to the first valve element and has a first pilot fluid inlet. A second pilot is fluidically coupled to the second valve element and has a second pilot fluid inlet. A third pilot is fluidically coupled to the third valve element and has a third pilot fluid inlet. A fourth pilot is fluidically coupled to the fourth valve element having a fourth pilot fluid inlet. A first interconnection fluidically couples the first crossover passage with the third pilot fluid inlet. A second interconnection fluidically couples the second crossover passage with the fourth pilot fluid inlet. A third interconnection fluidically couples the third crossover passage with the first pilot fluid inlet. A fourth interconnection fluidically couples the fourth crossover passage with the second pilot fluid inlet.

DETAILED DESCRIPTION OF PREFERRED EMBODIMENTS

Figure 1:
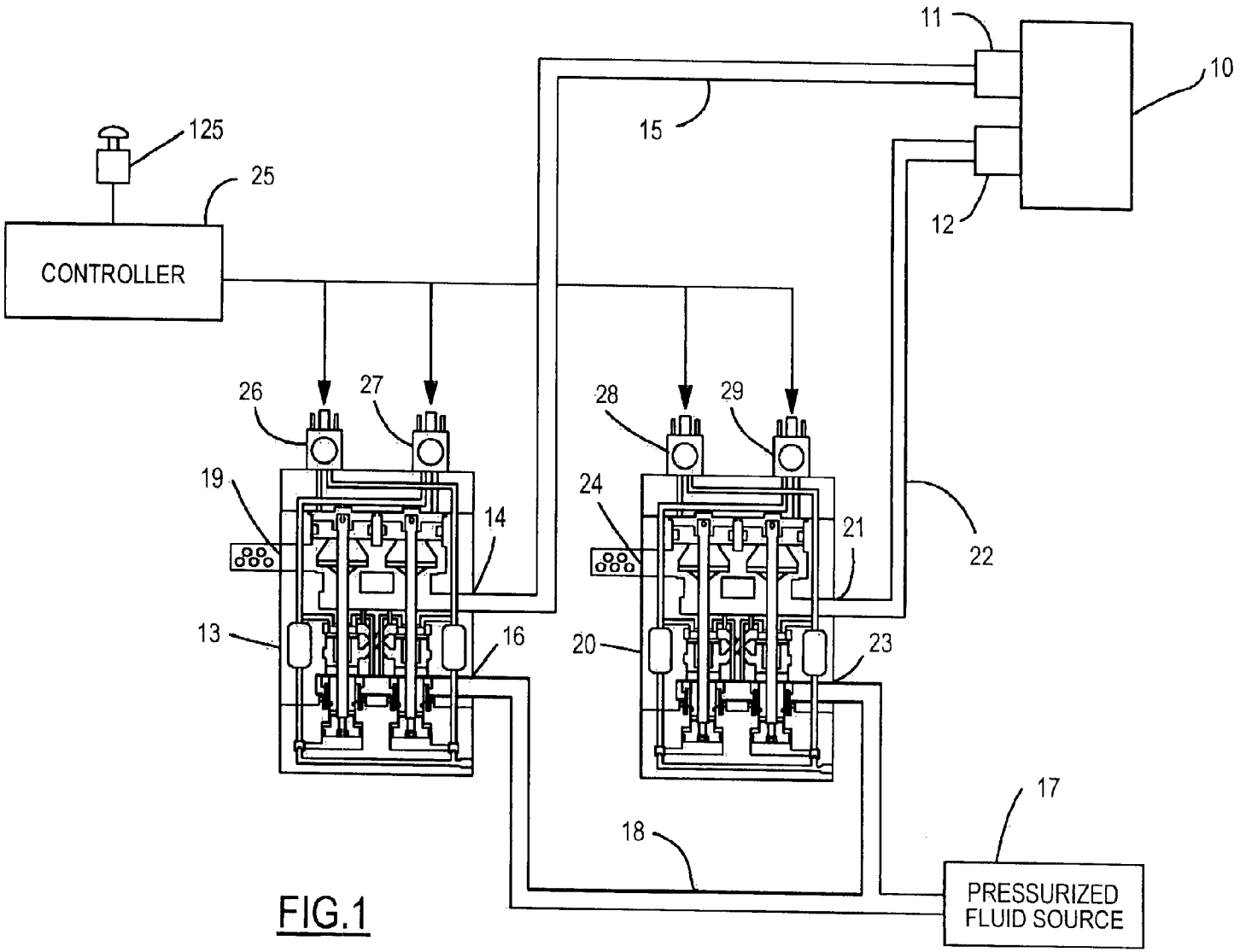
FIG. 1 is a block diagram showing a conventional system for controlling brake and clutch actuators for a mechanical power press.

Referring to FIG. 1, a press 10 includes a brake actuator 11 and a clutch actuator 12. A first double valve 13 has an outlet port 14 connected to brake actuator 11 by a pressure line 15. Double valve 13 also includes an inlet port 16 for coupling with a pressurized fluid source 17 by a pressure line 18. An exhaust port 19 of double valve 13 is coupled to atmosphere and may include a silencer.

A second double valve 20 has an outlet port 21 coupled to clutch actuator 12 by a pressure line 22. Inlet port 23 is coupled to pressurized fluid source 17 by a branch of pressure line 18 and an exhaust port 24 is coupled to atmosphere and may include a silencer.

An electronic controller 25 is coupled to pilot valves 26 and 27 on double valve 13 and to pilot valves 28 and 29 on double valve 20. A switch 125 is coupled to controller 25 for allowing a press operator to initiate the machine cycle process of press 10 by signaling controller 25, which will generate a control signal to start a machine cycle of press 10. Controller 25 provides the electrical control signals to pilot valves 26-29 in a conventional manner.

Double valves 13 and 20 are shown having an internal crossover structure between the valve elements within each double valve. The timing chambers within each double valve are pressurized by inlet pressurized fluid flowing through respective restrictions. In a normal operation cycle, electrical signals cause the pilot valves to actuate and apply pressure to the valve elements. Pressure acting against the main valve pistons of the valve elements cause the valve elements to move to their actuated positions so that the pressurized fluid flows between the inlet port and outlet port via the respective crossover passages. When the electrical signals are removed from the pilot valves, the pilot valves return to their normal deactuated positions and the main valve chambers are exhausted to atmosphere. Pressure from the timing chamber then operates on the valve elements to return them to their deactuated positions. Thus, during normal operation the valve elements in a double valve operate together in a synchronous manner.

When any malfunction arises in connection with any valve element (e.g., a stuck valve element), the valve elements will cease to move synchronously. As a result, one main valve element is in an actuated position (either partially or fully) while the other main valve element is in the returned, deactuated position. These abnormal positions cause the crossover passage and timing chamber of one side of a double valve to be pressurized in a normal manner while the crossover passage and timing chamber of the other half of the double valve are exhausted to atmosphere. The double valve remains in this fault state until reset by a separate mechanism.

The present invention interconnects the two double valves so that synchronous operation of valve elements in each double valve depends in part upon the other double valve not being in a faulted state. The crossover passages of each double valve inherently remain under full inlet pressure during the normal actuated and deactuated states of the valve. However, when at least one double valve is in the fault state, the corresponding crossover passage falls to substantially atmospheric pressure because the crossover passage becomes fluidically coupled to the exhaust port (i.e., the faulted double valve cannot actuate the clutch or brake actuator that it is intended to control). The present invention interconnects each crossover passage with a pilot valve inlet of the opposite double valve whereby a pilot valve can provide pressurized fluid to activate a corresponding valve element only if the opposite double valve is not faulted on the side of the double valve from which it receives pressurized fluid (i.e., the double valve not experiencing the initial fault will become unable to actuate the clutch or brake actuator that it is intended to control).

Besides the crossover passages, the timing chambers coupled to the crossover passages could alternatively be used as a source of pressurized fluid that would fail to provide pressure when a valve is faulted, but they are not preferred because fast operation of the present invention is important and the timing chambers take longer to fall to atmospheric pressure since they are exhausted through a restriction. Thus, it is preferred to use the crossover passage as the source of pressurized fluid rather than a timing chamber.

Figure 2:
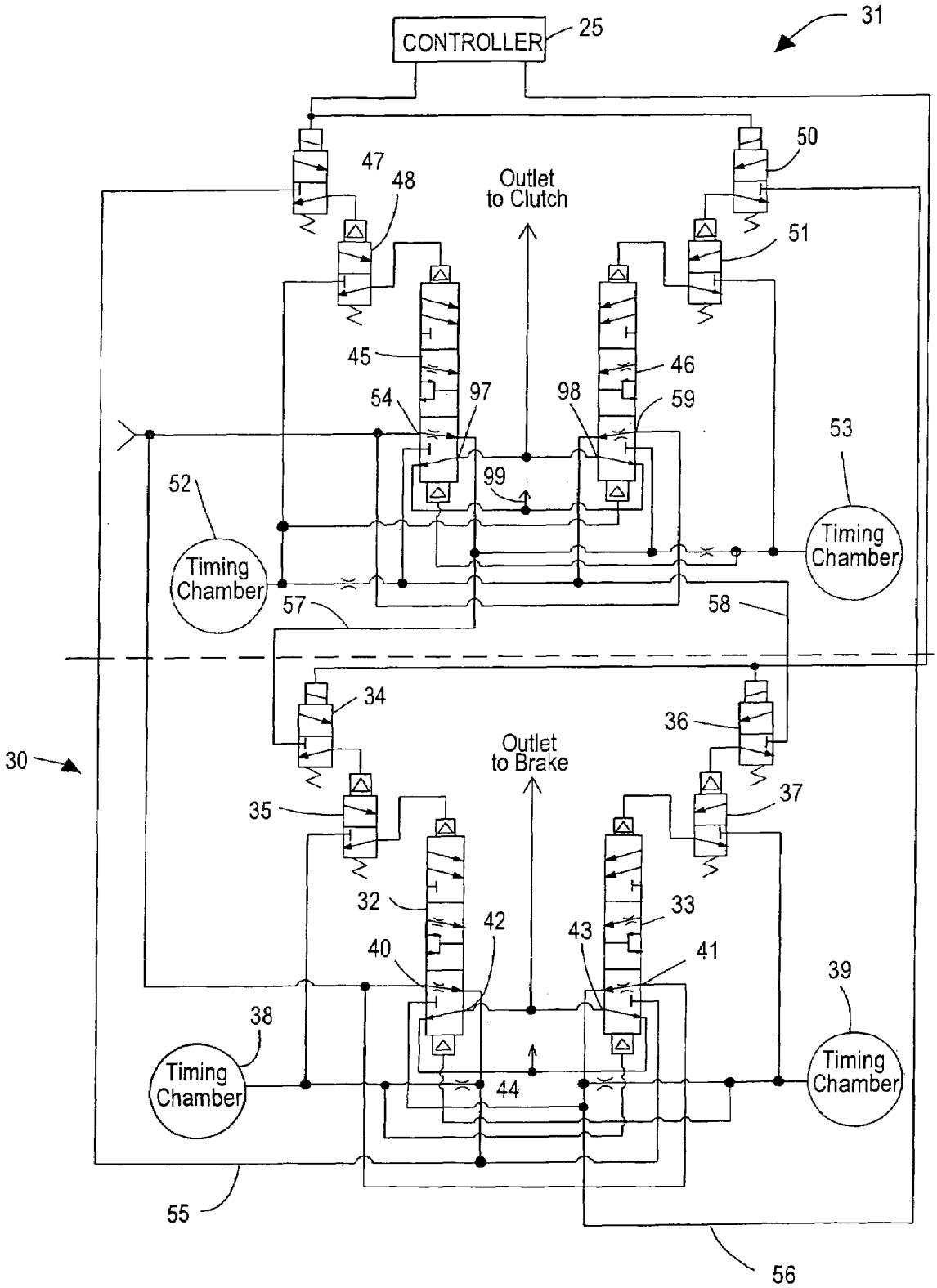
FIG. 2 is a schematic diagram of a preferred embodiment of the present invention for interconnecting two double valves.
Figure 3:
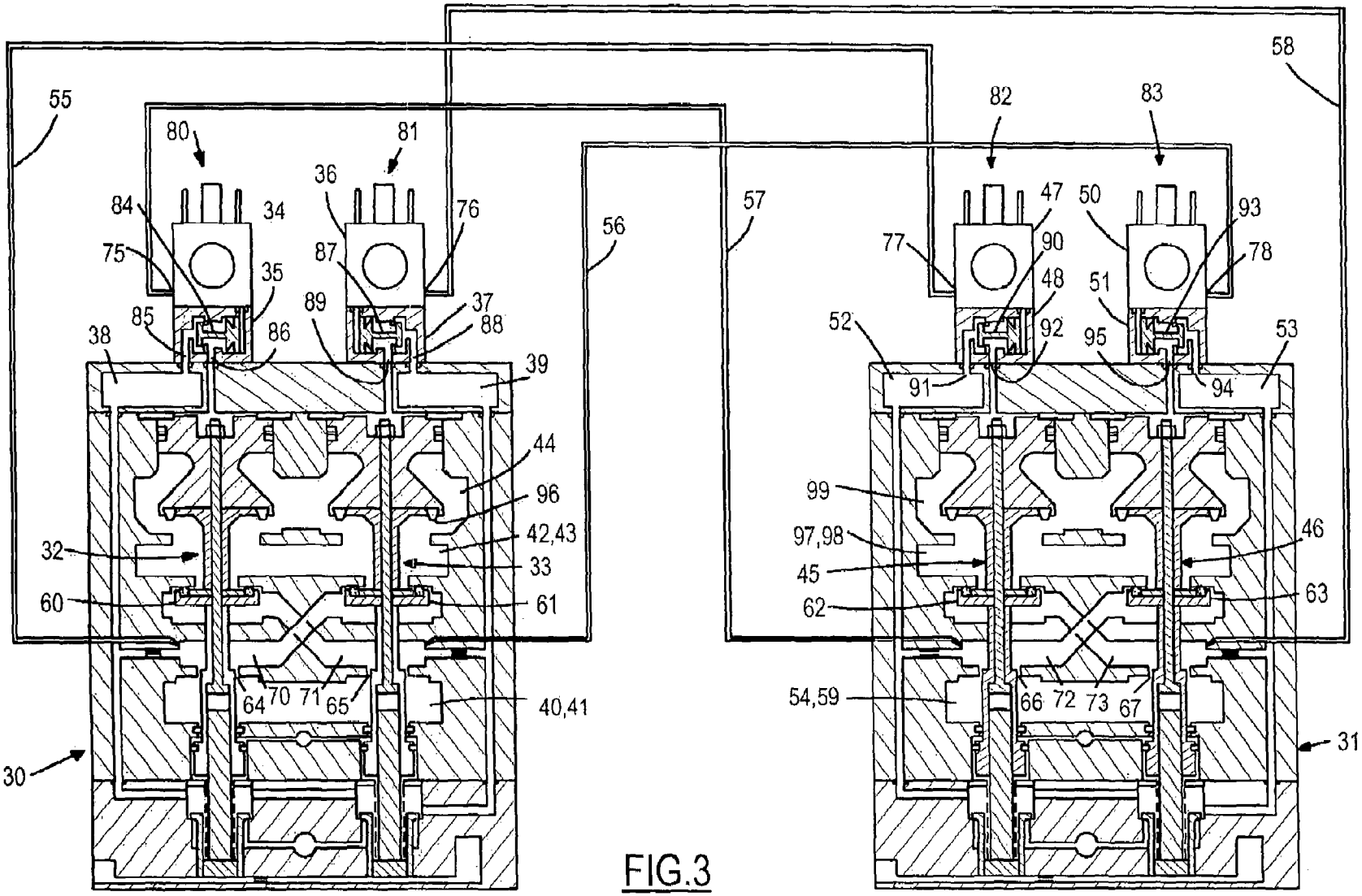
FIG. 3 is a partial cross-sectional plan view of the interconnected double valves in their deactuated state.

Referring now to FIGS. 2 and 3, a schematic diagram shows a first double valve 30 and a second double valve 31 connected in accordance with a preferred embodiment of the present invention. All like numerals in FIGS. 2-5 refer to the identical components. Double valves 30 and 31 are shown as $DM^{2}$™ Crossflow SERPAR® double valves available from Ross Controls of Troy, Mich. and are embodiments of U.S. Pat. Nos. 6,840,258 and/or 6,840,259. Double valve 30 includes a first valve element 32 and a second valve element 33. In this embodiment, the pilot valves are combined with booster pilots for providing fast valve operation with low current consumption, although a booster is not required. Thus, a first pilot 34 is connected to a first booster pilot 35 for controlling first valve element 32. Second pilot 36 is connected to second booster pilot 37 for controlling second valve element 33. Booster pilots 35 and 37 receive their inlet fluid pressure supply from timing chambers 38 and 39, respectively, in a conventional manner. Inlets 40 and 41 receive pressurized fluid from a pressurized fluid source, such as a compressor (not shown). Outlets 42 and 43 are connected to the brake actuator. An exhaust 44 is connected to atmospheric pressure.

Second double valve 31 includes third and fourth valve elements 45 and 46. A third pilot 47 is connected to a third booster pilot 48 for controlling third valve element 45. Fourth pilot 50 is connected to fourth booster pilot 51 for controlling fourth valve element 46. Booster pilots 48 and 51 receive inlet fluid from timing chambers 52 and 53, respectively. Inlets 54 and 59 receive pressurized fluid from the pressurized fluid source. Outlets 97 and 98 are connected to the brake actuator. An exhaust 99 is connected to atmospheric pressure.

A first interconnection between double valves 30, 31 comprises a first fluid line 55 between a first crossover passage 70 of valve element 32 and the inlet of pilot 47. A second interconnection comprises a second fluid line 56 coupled between a second crossover passage 71 of valve element 33 and the inlet of pilot 50. Likewise, a third interconnection is comprised of a third fluid line 57 between a third crossover passage 72 of valve element 45 in double valve 31 and the inlet of pilot 34 of double valve 30, and a fourth interconnection is comprised of a fourth fluid line 58 coupled between a fourth crossover passage 73 of valve element 46 and the inlet of pilot 36. It should be noted that there are several other possible pairings between the double valves. For example, the "left"

side pilot 34 of double valve 30 could receive fluid from either crossover passage 72, 73 of double valve 31 while the "left" side crossover passage 70 of double valve 30 could be providing fluid to either pilot 47, 50 of double valve 31 (i.e., without regard to which connection is chosen for left side pilot 34). However, the details of the valve timing utilized in a particular double valve design may result in operational differences depending upon which interconnect pairings are chosen. With regard to the DM$^{2}$™ Crossflow SERPAR® double valves mentioned above, the pairings shown in FIGS. 2-5 are preferred.

The interconnected double valves 30, 31 are shown in cross-sectional view in FIG. 3 while in their deactuated states. Valve element 32 in double valve 30 includes a first inlet poppet 60 and valve element 33 includes a second inlet poppet 61. In double valve 31, valve element 45 includes a third inlet poppet 62 and valve element 46 includes a fourth inlet poppet 63. Each valve element creates a first, second, third and fourth flow restrictor 64-67, respectively, continuously supplying pressurized fluid from inlets 40, 41, 54, 59 to respective crossover passages 70-73.

With each valve element 32, 33, 45, 46 in its deactuated position, as shown in FIG. 3, inlet poppets 60-63 are closed, and once pressurized fluid has been admitted to inlets 40, 41, 54, 59 then the pressure in crossover passages 70-73 equalizes to that same (inlet) pressure.

Fluid lines 55-58 feed from crossover passages 70-73, respectively, to connect with pilot fluid inlets 75-78 of pilots 34, 36, 47, and 50. Each fluid line 55-58 extends between the double valves such that fluid line 55 interconnects crossover passage 70 with pilot inlet 77 of pilot 47; fluid line 56 interconnects crossover passage 71 with pilot inlet 78 of pilot 50; fluid line 57 interconnects crossover passage 72 with pilot inlet 75 of pilot 34; and fluid line 58 interconnects crossover passage 73 with pilot inlet 76 of pilot 36. The pilots 34, 36, 47, 50 further include respective electrical control inputs 80-83 for connecting with controller 25 in a conventional manner.

Figure 4:
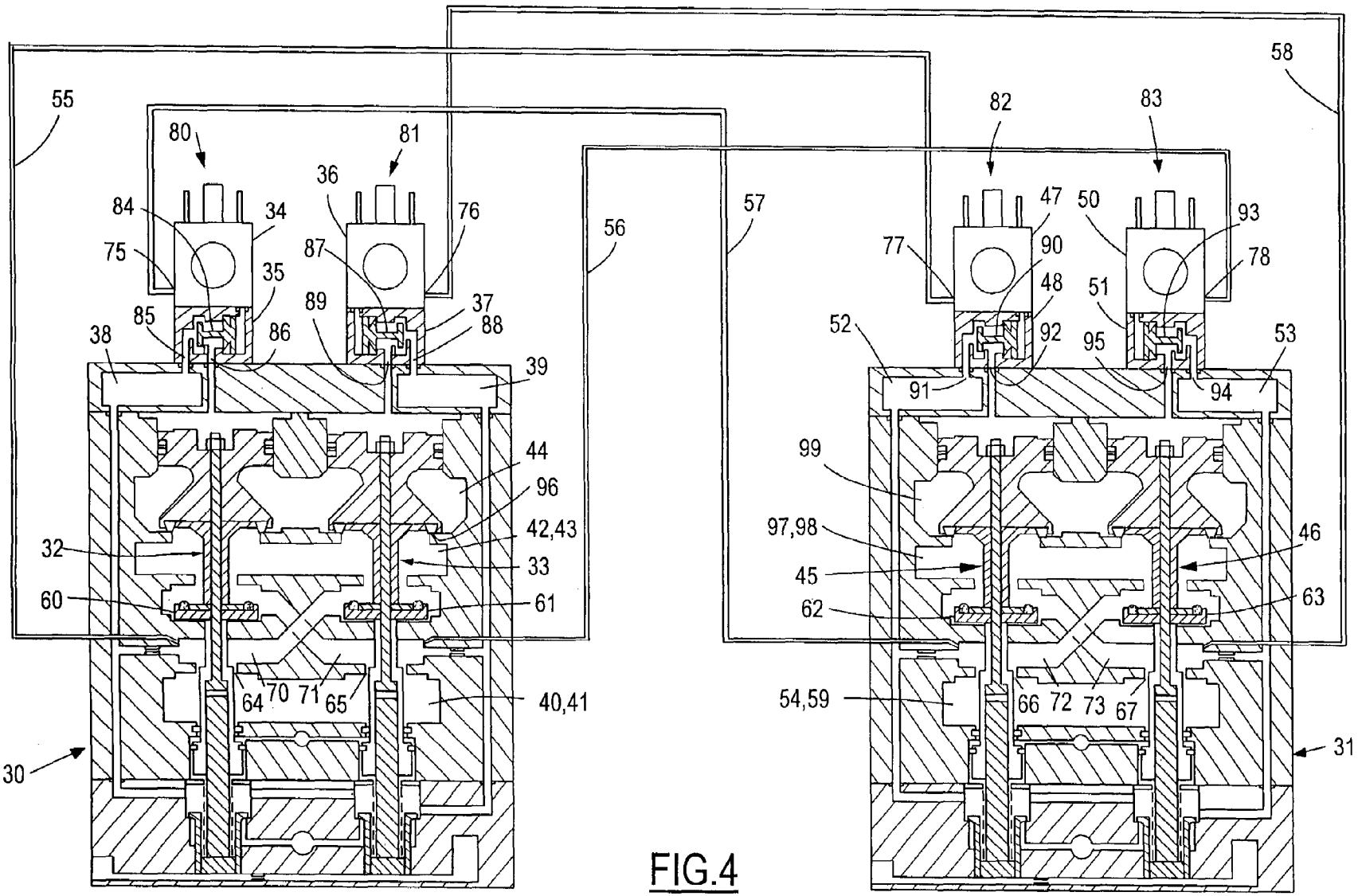
FIG. 4 is a partial cross-sectional plan view of the interconnected double valves in their actuated state.

In response to the pressurized fluid received from a crossover passage 70-73 of the opposite double valve 30,31, each pilot 34, 36, 47, 50 controls a respective booster pilot 35, 37, 48, 51 according to the electrical control signal sent by controller 25. Pilots 34, 36, 47, and 50 each can be comprised of a three-way pilot having an outlet connected to drive a booster valve element in each booster pilot 35, 37, 48, 51. Thus, booster pilot 35 includes a booster element 84 for selectably interconnecting booster inlet 85 to booster outlet 86. Booster pilot 37 includes a booster element 87 for selectably interconnecting booster inlet 88 with booster outlet 89. Booster pilot 48 includes a booster element 90 for selectably interconnecting booster inlet 91 with booster outlet 92. Booster pilot 51 includes a booster element 93 for selectably interconnecting booster inlet 94 with booster outlet 95. The booster inlets 85, 88, 91, 94 receive pressurized fluid from timing chambers 38, 39, 52, and 53, respectively. With each pilot 34, 36, 47, 50 deactuated, each respective pilot outlet, which is connected to a corresponding booster control element 84, 87, 90, 93, is exhausted so that pressurized fluid from a corresponding timing chamber 38, 39, 52, 53 is blocked from the respective booster outlet 86, 89, 92, 95 and each respective main valve control element 32, 33, 45, 46 remains in its deactuated position. Since each crossover passage 70-73 is fully pressurized, inlet pressure is available to each pilot 34, 36, 47, 50 so that when activated, the fluid pressure will be able to reposition the respective booster control element 84, 87, 90, 93 to an actuated position. Once the respective booster control element 84, 87, 90, 93 is in an actuated position, pressurized fluid from the respective timing chamber 38, 39, 52, 53 is applied against the corresponding valve element 32, 33, 45, 46 to put each double valve 30, 31 in its actuated state as shown in FIG. 4. When double valves 30, 31 are in their actuated states, crossover passages 70-73 continue to maintain full pressure thereby allowing pilots 34, 36, 47, 50 to continue their control over their respective booster pilots 35, 37, 48, 51 and their respective valve elements 32, 33, 45, 46. Although both double valves 30, 31 are shown in FIG. 4 as being in their actuated states simultaneously, double valves 30, 31 could also be actuated one at a time whenever desired since full pressure is available in all crossover passages 70-73 for as long as both double valves 30, 31 are operating properly.

Interconnection of each pilot 34, 36, 47, 50 with a crossover passage of the other double valve 30, 31 creates an AND-function in the inherent control logic of the double valves 30, 31 wherein a particular valve element 32, 33, 45, 46 can actuate only if the pilot 34, 36, 47, 50 associated with the valve element 32, 33, 45, 46 receives both a control signal and pressurized fluid from the other double valve 30, 31. Upon occurrence of a fault, the loss of pressure in one crossover passage 70-73 that accompanies the failure of a double valve 30, 31 propagates to one of the pilots 34, 36, 47, 50 of the unfaulted valve. Loss of pressure to the pilot disables its ability to activate the piston of the corresponding valve element 32, 33, 45, 46 in the unfaulted valve 30, 31.

A typical mechanism for causing a fault is the sticking of a valve element 32, 33, 45, 46 due to foreign matter or corrosion. Because it is extremely unlikely that both valve elements of a double valve 30, 31 would become stuck in the same position at the same time, the sticking of a valve element will cause the motion of the valve elements to be non-synchronous. Because of the configuration of the double valve, the non-synchronous movement causes it to become locked out in a faulted state with the outlet port 42, 43, 97, 98 tied to the exhaust port 44, 99.

Figure 5:
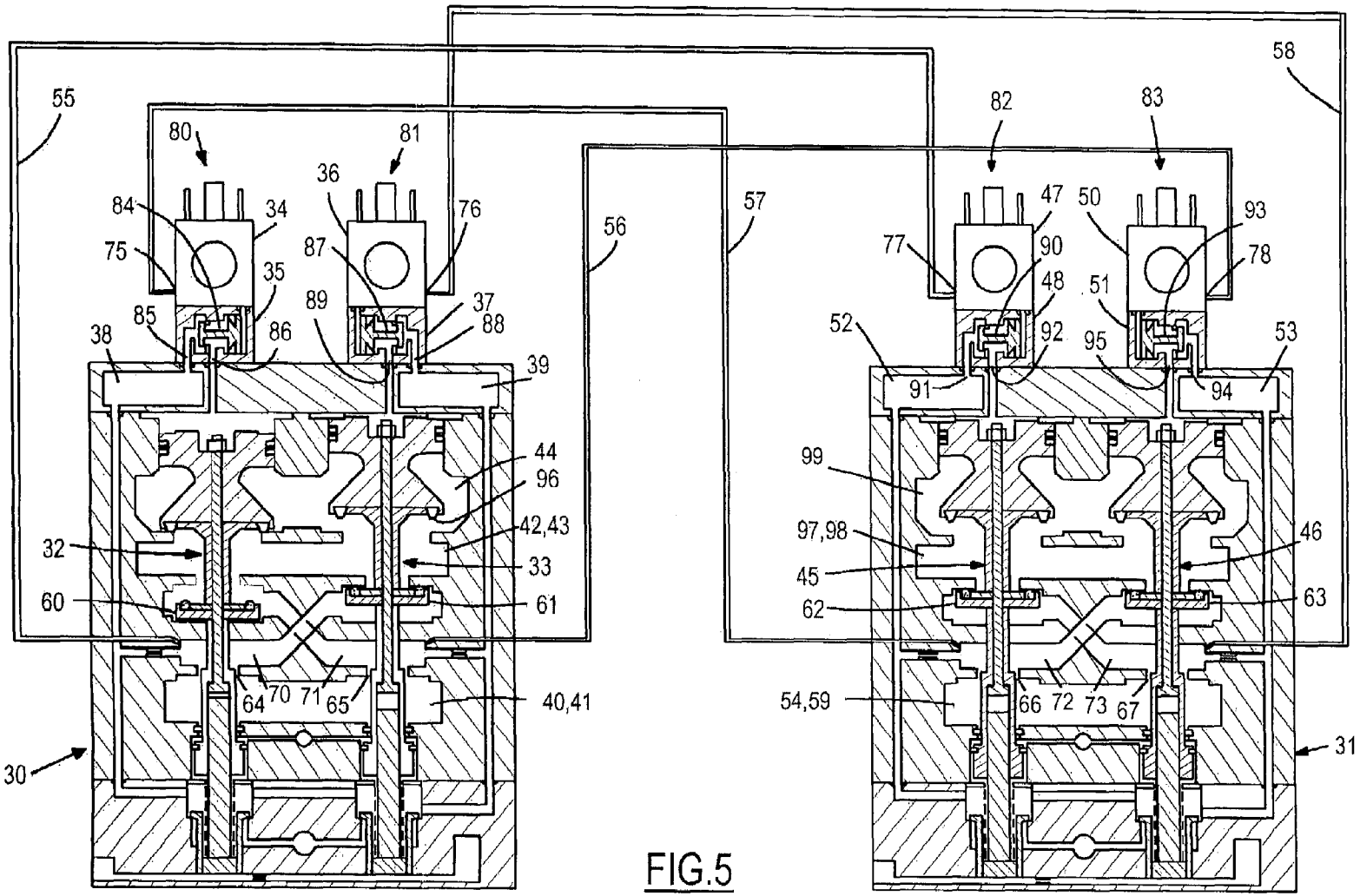
FIG. 5 is a partial cross-sectional plan view of the interconnected double valves in their faulted state.

FIG. 5 shows double valve 30 in a faulted state. Specifically, valve element 32 is fully or partially actuated while valve element 33 is in its deactuated position. Consequently, crossover passage 71 is connected to the exhaust outlet 44 through inlet poppet 60 of valve element 32 and an exhaust poppet 96 of valve element 33. Due to the depressurization of crossover passage 71, timing chamber 39 depressurizes so that regardless of the control signal to pilot 36, booster pilot 37 cannot drive control element 33 to its actuated position. Also because of the depressurized state of crossover passage 71, line 56 fails to provide any pressurized fluid to inlet 78 of pilot 50 on double valve 31. Double valve 31 is shown in a deactuated state (i.e., double valve 31 was in a deactuated state when double valve 30 became faulted). If double valve 31 attempts to actuate while double valve 30 is in a faulted condition, then only valve element 45 will move downward to its actuated position since only pilot 47 is receiving pressurized fluid for driving its respective booster pilot 48. Consequently, double valve 31 will enter a fault state from which it can only recover by being specifically reset. If double valve 31 is in an actuated state when double valve 30 becomes faulted, then one of pilots 47, 50 will lose pressure and corresponding booster pilot 48, 51 will deactivate. Loss of booster pilot pressure will cause the corresponding valve element 45, 46 to move to its deactuated position resulting in the same faulted state in double valve 31. With both double valves locked out in a faulted state, their outlet ports 42, 43, 97, 98 which are coupled to the clutch and brake actuators 11, 12, become tied to their exhaust ports 44, 99. With no outlet pressure available from the double valves 30, 31, no further press cycles can be initiated until the double valves 30, 31 are both reset.

Figure 6:
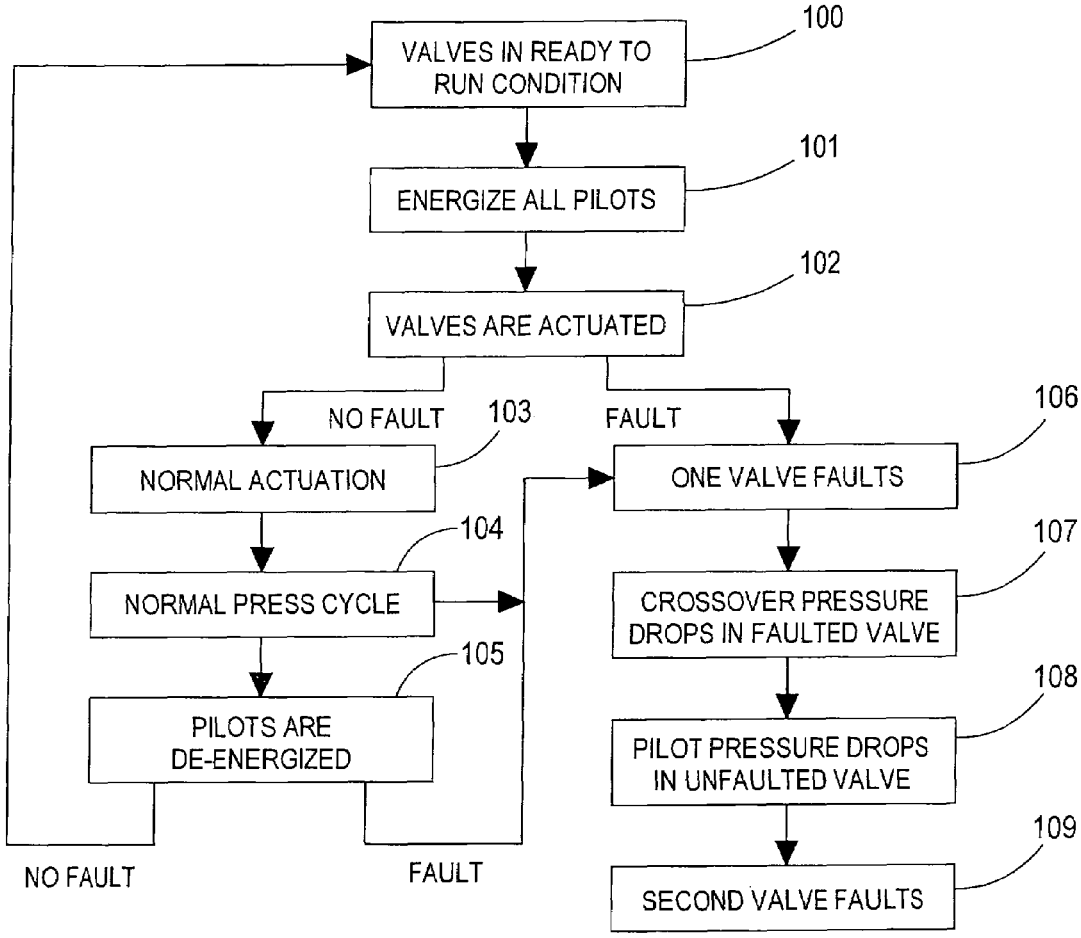
FIG. 6 is a flowchart showing a preferred method of the present invention.

FIG. 6 shows a preferred method of the present invention for controlling first and second fluid-driven actuators in a typical cycling of the brake and clutch of a machine press system. In step 100, both double valves are in a ready-to-run condition. All crossover passages and all interconnections to pilots are pressurized while the pilots are de-energized. In order to begin a cycle of the press, all pilots are energized in step 101. In step 102 the double valves are actuated in response to pilot pressure. Assuming that no faults occur during the synchronous actuation of the valve elements in each double valve, normal actuation of both double valves is achieved at step 103 and the outputs of both double valves to the clutch and brake are pressurized. A normal press cycle follows in step 104. At the end of a press cycle, the pilots are de-energized in step 105. If all the valve elements synchronously move to their deactuated positions without faulting, then the double valves return to their ready-to-run condition in step 100.

If one of the double valve elements faults in either step 102, 104, or 105, then the corresponding one of the double valves becomes faulted at step 106. At step 107, pressure drops in the corresponding crossover passage tied to the faulted valve element in the faulted valve. Because of the interconnection between double valves, pilot pressure drops to the corresponding pilot in the unfaulted double valve. Consequently, the second double valve faults in step 109 such that it cannot actuate (i.e., its outlet remains coupled to its exhaust port) until both double valves are deliberately reset. Therefore, as soon as one of the clutch or brake actuators becomes deactuated by a faulted double valve it becomes impossible to actuate the other one of the clutch or brake actuators, and press damage is prevented.

What is claimed is:

1. Control valve apparatus for coupling pressurized fluid to first and second actuators, comprising:

a first double valve comprising:

a first inlet for receiving said pressurized fluid;

a first outlet for coupling with said first actuator;

a first exhaust;

a first valve element having a first inlet poppet and a first flow restrictor;

a second valve element having a second inlet poppet and a second flow restrictor;

a first crossover passage fluidically coupling said first flow restrictor to said second inlet poppet, and a second crossover passage fluidically coupling said second flow restrictor to said first inlet poppet;

a second double valve comprising:

a second inlet for receiving said pressurized fluid;

a second outlet for coupling with said second actuator;

a second exhaust;

a third valve element having a third inlet poppet and a third flow restrictor;

a fourth valve element having a fourth inlet poppet and a fourth flow restrictor;

a third crossover passage coupling said third flow restrictor to said fourth inlet poppet; and a fourth crossover passage coupling said fourth flow restrictor to said third inlet poppet;

a first pilot fluidically coupled to said first valve element, said first pilot having a first pilot fluid inlet;

a second pilot fluidically coupled to said second valve element, said second pilot having a second pilot fluid inlet;

a third pilot fluidically coupled to said third valve element, said third pilot having a third pilot fluid inlet;

a fourth pilot fluidically coupled to said fourth valve element, said fourth pilot having a fourth pilot fluid inlet;

a first interconnection fluidically coupling said first crossover passage with said third pilot fluid inlet;

a second interconnection fluidically coupling said second crossover passage with said fourth pilot fluid inlet;

a third interconnection fluidically coupling said third crossover passage with said first pilot fluid inlet; and a fourth interconnection fluidically coupling said fourth crossover passage with said second pilot fluid inlet.

2. The control valve apparatus of claim 1 wherein each of said pilots comprises:

a three-way pilot having a respective pilot fluid inlet and an electrical control input.

3. The control valve apparatus of claim 2 wherein each of said pilots further comprises:

a booster pilot controlled by said pilot to drive a respective one of said valve elements.

4. The control valve apparatus of claim 3 wherein said booster pilots each include a respective booster inlet and a respective booster outlet, and wherein said booster inlets receive pressurized fluid from their respective double valve.

5. The control valve apparatus of claim 4 wherein said first and second double valves each include first and second timing chambers for supplying pressurized fluid from a respective crossover passage to a respective booster pilot.

6. The control valve apparatus of claim 1 wherein each of said first, second, third, and fourth interconnections comprises a respective fluid line extending between said first and second double valves.

7. A method of controlling first and second fluid-driven actuators comprising the steps of:

coupling a first double valve to control said first actuator and a second double valve to control said second actuator, wherein each double valve has a respective inlet, outlet, exhaust, and pair of crossover passages, wherein each double valve has a respective pilot valve with a pilot inlet, and wherein each double valve has a deactuated state, an actuated state, and a faulted state;

pressurizing said inlets with a pressurized fluid;

pressurizing said crossover passages using said pressurized fluid from said inlets while said double valves are each in a state other than said faulted state;

supplying pressurized fluid from each respective crossover passage of said first double valve to a respective pilot inlet of said second double valve;

supplying pressurized fluid from each respective crossover passage of said second double valve to a respective pilot inlet of said first double valve;

energizing each respective pilot valve according to a desired operation of said first and second actuators to controllably move said double valves between said respective deactuated and actuated states; and if one of said double valves enters a faulted state then depressurizing a respective crossover passage, thereby removing said pressurized fluid from a respective one of said pilot inlets to cause the other one of said double valves to assume said faulted state.

8. The method of claim 7 wherein a respective booster pilot is coupled between each pilot valve and a respective double valve, when a respective pilot valve is energized then said pressurized fluid from a respective crossover passage is provided for actuating said respective booster pilot.

9. The method of claim 8 wherein each booster pilot includes a respective booster inlet, said method further comprising the step of:

supplying pressurized fluid to each respective booster inlet from a corresponding timing chamber receiving pressurized fluid from a respective crossover passage.

10. The method of claim 7 wherein said first and second actuators are comprised of a clutch and a brake, respectively, of a machine press.

11. A machine press system operable from a source of pressurized fluid comprising:

a brake actuator;

a clutch actuator;

a first double valve comprising:

a first inlet for receiving said pressurized fluid;

a first outlet for coupling with said first actuator;

a first exhaust;

a first valve element having a first inlet poppet and a first flow restrictor;

a second valve element having a second inlet poppet and a second flow restrictor;

a first crossover passage fluidically coupling said first flow restrictor to said second inlet poppet, and a second crossover passage fluidically coupling said second flow restrictor to said first inlet poppet;

a second double valve comprising:

a second inlet for receiving said pressurized fluid;

a second outlet for coupling with said second actuator;

a second exhaust;

a third valve element having a third inlet poppet and a third flow restrictor;

a fourth valve element having a fourth inlet poppet and a fourth flow restrictor;

a third crossover passage coupling said third flow restrictor to said fourth inlet poppet; and a fourth crossover passage coupling said fourth flow restrictor to said third inlet poppet;

a first pilot fluidically coupled to said first valve element, said first pilot having a first pilot fluid inlet;

a second pilot fluidically coupled to said second valve element, said second pilot having a second pilot fluid inlet;

a third pilot fluidically coupled to said third valve element, said third pilot having a third pilot fluid inlet;

a fourth pilot fluidically coupled to said fourth valve element, said fourth pilot having a fourth pilot fluid inlet;

a first interconnection fluidically coupling said first crossover passage with said third pilot fluid inlet;

a second interconnection fluidically coupling said second crossover passage with said fourth pilot fluid inlet;

a third interconnection fluidically coupling said third crossover passage with said first pilot fluid inlet; and a fourth interconnection fluidically coupling said fourth crossover passage with said second pilot fluid inlet.

12. The machine press system of claim 11 wherein each of said pilots comprises:

a three-way pilot having a respective pilot fluid inlet and an electrical control input.

13. The machine press system of claim 12 wherein each of said pilots further comprises:

a booster pilot controlled by said pilot to drive a respective one of said valve elements.

14. The machine press system of claim 13 wherein said booster pilots each include a respective booster inlet and a respective booster outlet, and wherein said booster inlets receive pressurized fluid from their respective double valve.

15. The machine press system of claim 14 wherein said first and second double valves each include first and second timing chambers for supplying pressurized fluid from a respective crossover passage to a respective booster pilot.

16. The machine press system of claim 11 wherein each of said first, second, third, and fourth interconnections comprises a respective fluid line extending between said first and second double valves.

* * * * *